United States Patent [19]

Martin

[11] 4,271,543

[45] Jun. 9, 1981

[54] SHOWER BAR WITH SLIDING SPRAY HEAD

[75] Inventor: Jean Martin, La Barriere, France

[73] Assignee: Valentin S.A., Bourseville, France

[21] Appl. No.: 96,132

[22] Filed: Nov. 20, 1979

[30] Foreign Application Priority Data

Dec. 27, 1978 [FR] France ..... 78 36426

[51] Int. Cl.[3] ..... A47K 3/22; B05B 15/06

[52] U.S. Cl. ..... 4/615; 4/596; 4/604; 4/612; 239/282

[58] Field of Search ..... 239/185, 186, 282, 587; 4/145, 158, 567, 570, 596, 597, 600, 604, 605, 612, 615; 187/21, 23

[56] References Cited

U.S. PATENT DOCUMENTS

| | | | |
|---|---|---|---|
| 759,087 | 5/1904 | Foley | 187/23 |
| 1,587,353 | 6/1926 | Pfeufer | 4/158 |
| 1,982,509 | 11/1934 | Frank | 4/145 |
| 3,806,963 | 4/1974 | Flynn | 4/145 |

FOREIGN PATENT DOCUMENTS

| | | | |
|---|---|---|---|
| 2432275 | 1/1976 | Fed. Rep. of Germany | 4/145 |
| 2380009 | 9/1978 | France | 4/145 |
| 2407301 | 5/1979 | France | 4/145 |

*Primary Examiner*—Johnny D. Cherry
*Attorney, Agent, or Firm*—Darby & Darby

[57] ABSTRACT

A shower device has a bar on which slide a spray head support and a manually operable grip. At least two continuous chains, one connected to the grip and another to the spray head support, pass over a respective pulley mounted at each end of the bar. At one end of the bar the pulleys of two adjacent chains are connected to rotate with one another and the pulleys at the other end of the bar rotate independently with one of the pulleys at one end of the bar over which passes the chain for the spray head having a larger diameter to vary the ratio of movement between the grip and the head.

12 Claims, 11 Drawing Figures

4
12
13
11
14
1
30
2
20
6
15
7
16
5
3
21
18
10
19
4
9
8

11
12
13
2
14
6
5
3
9
8
10
7

SHOWER BAR WITH SLIDING SPRAY HEAD

FIELD OF THE INVENTION

The present invention relates to a spray head which is fed by a flexible tube and which is set up so that it slides along a vertical bar attached to a wall, thereby enabling its height to be adjusted.

BACKGROUND OF THE INVENTION

The practical production of a mounting bar for a sliding spray head of this kind is not without difficulties. In numerous cases, the sliding does not work efficiently, or the spray head tends to descend under its own weight and under the weight of the water contained in the flexible tube, or manouvering the spray head requires action both on the spray head and on an attachment piece, which is inconvenient. Furthermore, the systems which are used are usually expensive and difficult to produce industrially.

SUMMARY OF THE INVENTION

The shower bar according to the invention aims at solving the problem by simple and efficient means which are also not very expensive.

According to the invention there is provided a shower device comprising a bar and a spray head support and a grip slidably mounted on the bar. Pulleys are provided at each end of the bar and at least two continuous chains are used, one being connected to the grip and another to the support. Both chains pass around respective pulleys at the ends of the bar, the pulleys of two adjacent chains being independently rotatable at one end of the bar and being connected in rotation to one another at the other end of the bar.

By giving different diameters of these last mentioned pulleys, displacements for the grip and the support are obtained, the ratio of which is that of the diameters of the pulleys. By using three chains, with a pair of pulleys connected for rotation at each end of the bar and third pulley which is independently rotatable, an extensive range of displacement ratios between the grip and support of the spray head can be obtained.

The rail is preferably prismatic and tubular with the grip and the support sliding on the external surface of the bar. The bar has a longitudinal groove in which slide the arms which connect the grip and the support to the chains which are positioned inside the bar.

BRIEF DESCRIPTION OF THE DRAWINGS

FIG. 1 shows a spray head device according to the invention which comprises a prismatic bar 1 on which slide a support 2 which carries the spray head 20 and a grip 3 for maneuvering the head. The bar 1 is attached to the wall by supports 4 which form bracings and are positioned at the ends of the bar.

Figures 1, 2A, 2B, 3A, 3B, 4A, 4B:
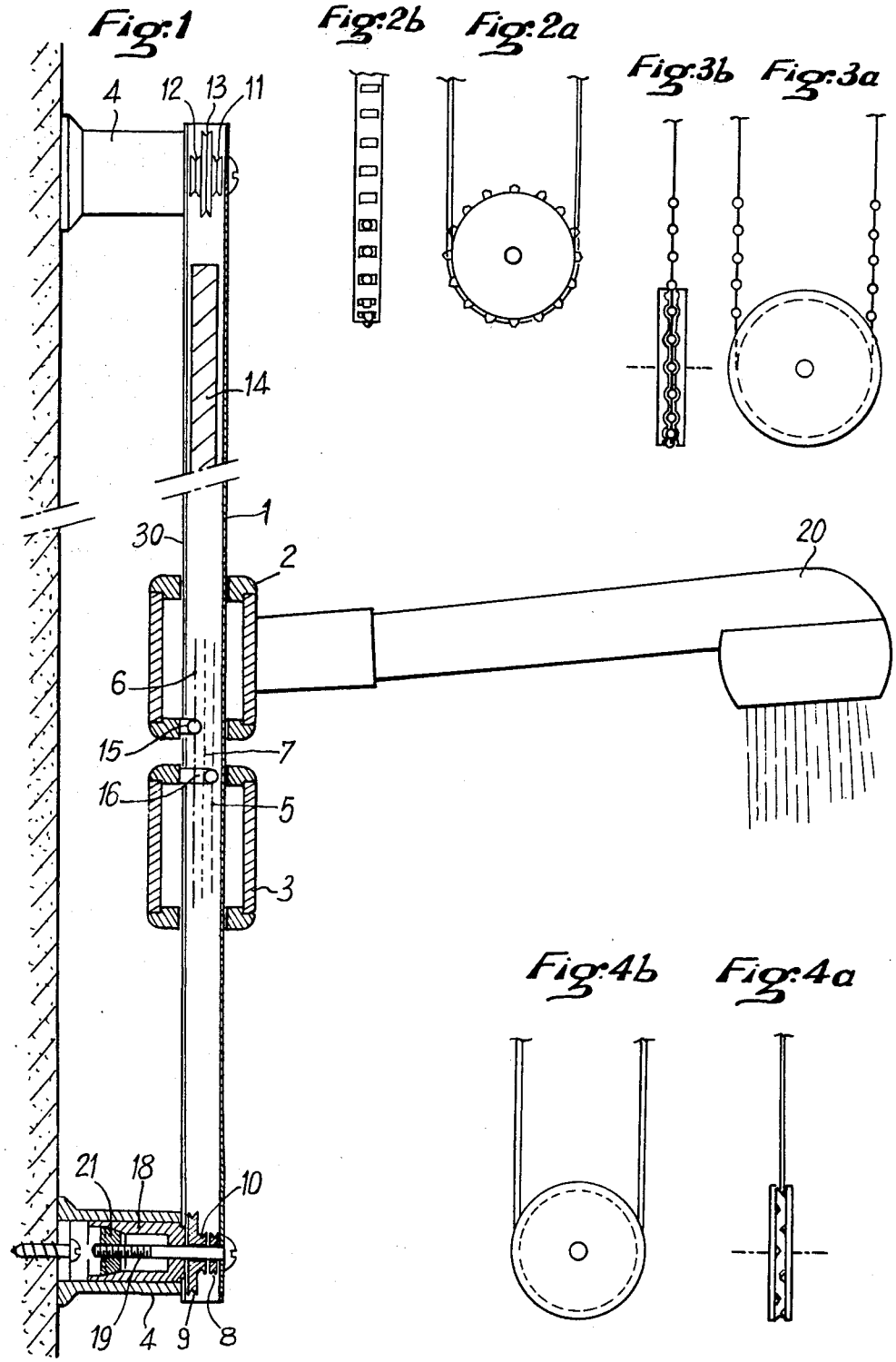
FIG. 1 is a partial longitudinal view, partly in section, of a device according to the invention.
FIGS. 2*a* and 2*b* show, from the front and from the side, an embodiment of the chain and pulley.
FIGS. 3*a* and 3*b* are variations of FIGS. 2*a* and 2*b* from the same views.
FIGS. 4*a* and 4*b* are variations of FIGS. 2*a* and 2*b* from the same views.

A plurality of separate but continuous chains 5,6 and 7 are provided, which pass around end return pulleys 8,9,10 11, 12 and 13 and are rotatably mounted at each end of the bar. Chain 5 passes around the pulley pair 8, 11; chain 6 around pulley pair 9, 12; and chain 7 around pulley pair 10, 13. All of the chains are located inside the bar which has a longitudinal slot 30 into which arms 15 and 16 of the head 2 and grip 3 extend for connection to the respective chains 6 and 5. As described below, the pulleys 9 and 10 at one end of the bar are connected for rotation with pulley 8 being independently rotatable and the pulleys 11 and 13 at the other end of the bar are connected for rotation with pulley 12 being independently rotatable.

The operation of the system is shown in FIGS. 5*a*, 5*b*, 6*a* and 6*b*.

Figures 5A, 5B, 6A, 6B:
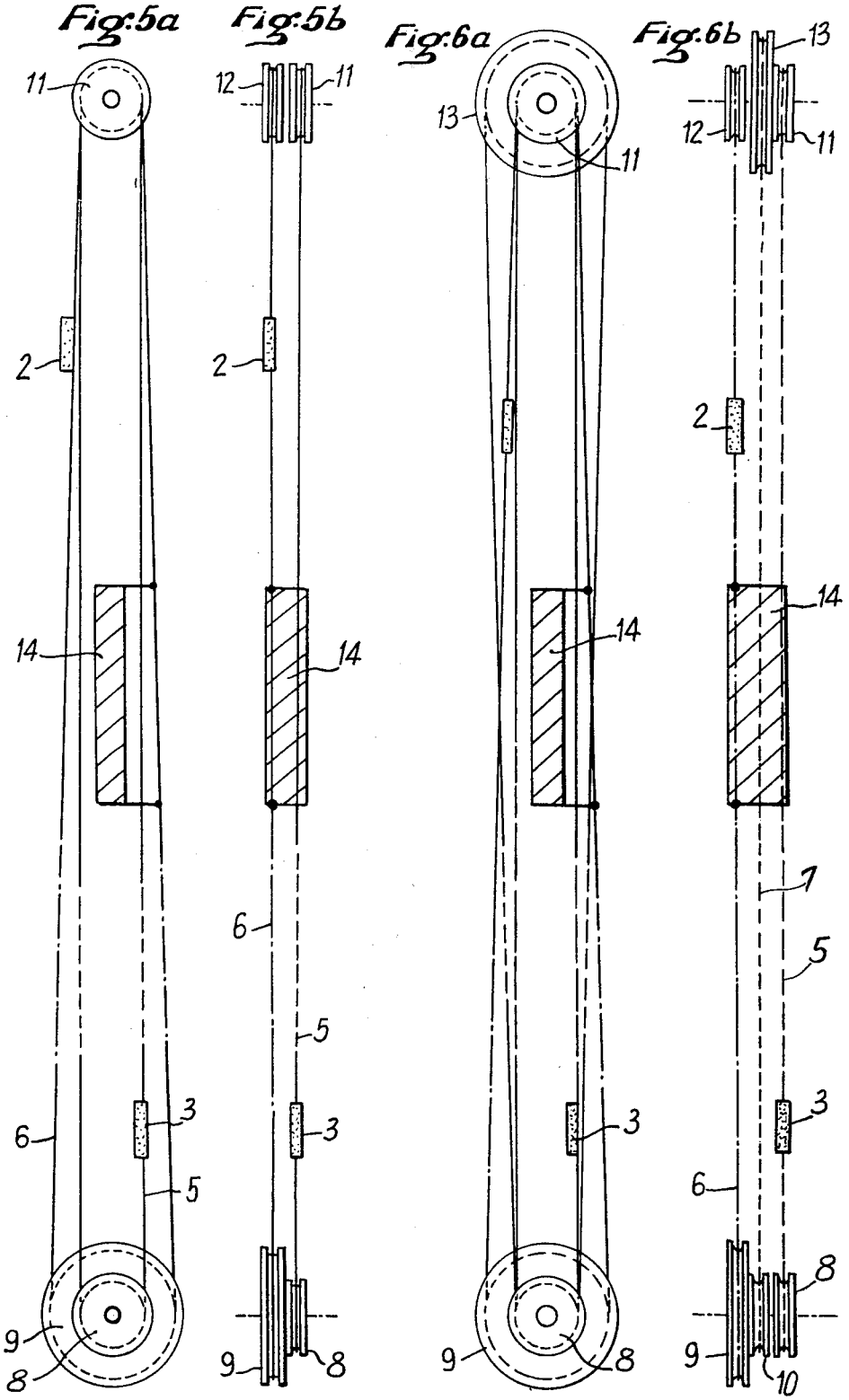
FIGS. 5*a* and 5*b* schematically show a variation of the invention with two chains.
FIGS. 6*a* and 6*b* schematically show a variation of the invention with three chains corresponding to FIG. 1.

In the case of the FIGS. 5*a* and 5*b*, there are two chains 5 and 6 which pass at one end around the pulleys 8 and 9, and at the other end around the pulleys 11 and 12. The grip 3 is attached to the chain 5 and the support 2 is attached to the chain 6. The pulleys 8 and 9 are connected for rotation but the pulleys 11 and 12 are not. From this results the fact that each movement of the grip 3 involves a movement of the support 2, the ratio of the displacements being equal to the ratio of the diameters of the pulleys 8 and 9. The displacements of the grip and the support are in the same direction or in an opposite direction according to whether they are attached to one or another part of the continuous chains 5 and 6.

In the case of FIGS. 5*a* and 5*b*, the ratio of the diameters of the pulleys 8 and 9 is 1:2 and the ratio of the displacements of the grip 3 and of the support 2 is likewise 1:2.

The embodiment of FIG. 1 which is shown schematically in FIGS. 6*a* and 6*b* allows a more extensive range of ratios to be obtained. In these figures, three chains 5, 6 and 7 are provided, three low pulleys 8, 9 and 10 and three high pulleys 11, 12 and 13. The support 2 is attached to the chain 6 and the grip 3 is attached to the chain 5. The pulleys 9 and 10 are connected in rotation as are the pulleys 11 and 13, but pulleys 8 and 12 rotate independently.

Thus the displacement of the grip 3 moves chain 5 and through the connected pulley pair 11, 13 results in the movement of the chain 7 with a displacement ratio and a velocity ratio equal to the ratio of the diameters of the pulleys 11 and 13. The displacement of the chain 7 involves through the connected pulley pair 9, 10 the displacement of the chain 6 and the spray head support 2 with a displacement and velocity ratio equal to that of the diameters of the pulleys 9 and 10. In the example shown, the ratio of displacements of the grip 3 and of the support 2 is equal to 1:4.

A requirement for the device to function effectively is the avoidance of slipping actions of the chains on the pulleys which transfer the movement from one chain to another chain. FIGS. 2*a*, 2*b*, 3*a*, 3*b* and 4*a*, 4*b*, show by way of example only, three ways of achieving this result economically and safely, and so as to be compatible with the production of the device on an industrial scale.

In the case of FIGS. 2*a* and 2*b*, the chains are in the form of perforated bands and the pulleys have sprockets as is known for the conveyance of photographic films.

In the case of FIGS. 3*a* and 3*b*, the chain is in the form of a cable with small balls and the pulley has a channel of small cavities.

In the case of FIGS. 4*a* and 4*b*, the chain is in the form of a cable and the pulley has a channel with alternate notches, constraining the cable to follow a sinuous path.

As is shown in the drawings a counterweight 14 is provided on the part of the return of the chain carrying the support 2. The weight of the counterweight is such as to counterbalance the weight of the spray head 20 and the flexible tube which is full of water and which feeds it.

The supports 4 allow vertical adjustment and adjustment of the distance from the wall. Thus, the support 4 is preferably attached to the wall via an oblong groove provided in its rear surface and it has an internal sliding piece 18 which carries the pulleys. The bar 1 is attached to the piece 18 by an attachment screw 19 which also forms an axle for the pulleys. The screw 19 causes the piece 18 to be locked by traction on a conical buffer 21 which penetrates inside the rear open end of the piece 18.

I claim:

1. An adjustable shower spray head device comprising:

a bar, means for mounting said bar generally vertically to a surface, a first set of pulleys rotatably mounted at one end of said bar and a second set of pulleys rotatably mounted at the other end of said bar, a pair of pulleys of one of said first and second sets connected to rotate together, and at least one pulley of the other set rotating independently, a first chain passing over one pulley of the connected pair of said one set and the independently rotatable pulley of the other set, and a second chain passing over the other pulley of the connected pair of said one set and a pulley of said other set, a spray head having a fluid passage slidably mounted on said bar and connected to one of said first and second chains, a grip means slidably mounted on said bar and connected to the other of said first and second chains, movement of said grip means moving said other chain and thereby rotating said connected pair of pulleys resulting in the movement of said one chain with the spray head connected thereto.

2. A device according to claim 1, wherein the bar is tubular and has a longitudinal slot therein, the chains located inside the bar and the spray head and the grip means slide on the external surface of the bar, each of said spray head and grip means having a respective arm passing through the said slot to the chains.

3. A device according to claim 1, wherein the chain to which the spray head is connected has a counterweight which is connected on the opposite part to that carrying the spray head.

4. A device according to claim 1, wherein the chains are in the form of perforated bands, and one of the pulleys is provided with sprockets which engage the perforations. of the bands.

5. A device according to claim 1, wherein the chain is in the form of a cable with small balls and one of the pulleys has a circumferential groove provided with small cavities which engage the said balls.

6. A device according to claim 1, wherein the chain is in the form of a cable and one of the pulleys has a circumferential groove of sinuous shape which engages the said chain.

7. A shower device according to claim 1, wherein said support for securing the bar to a surface comprises a first piece for attachment to the surface by a rear surface thereof and provided with an elongate groove, a second piece slidably received inside the first piece and having an open rear end, a screw securing the bar to the said second piece and serving as a pulley mounting, and a conical buffer received in the said open rear end of the said second piece and having the said screw threadedly received therein.

8. A device as in claim 1 wherein one of the pulleys of the first and second sets has a different diameter from the other pulleys of the set.

9. A device according to claim 8, wherein the pair of pulleys which are connected for rotation have different diameters.

10. An adjustable shower spray head device comprising:

a bar, means for mounting said bar generally vertically to a surface, a first set of pulleys rotatably mounted at one end of said bar and a second set of pulleys rotatably mounted at the other end of said bar, a pair of pulleys of each of said first and second sets connected to rotate together and one pulley of each set rotating independently, a first chain passing over one pulley of the connected pair of said first set and the independently rotatable pulley of the second set, a second chain passing over one pulley of the connected pair of said second set and the other pulley of the connected pair of said first set, and a third chain passing over the other pulley of the connected pair of said second set and the independently rotatable pulley of said first set, a spray head having a fluid passage slidably mounted on said bar and connected to one of said first and third chains, a grip means slidably mounted on said bar and connected to the other of said first and third chains, movement of said grip means moving said other chain and thereby rotating said connected pair of pulleys of one of said first and second sets of pulleys resulting in the movement of said one chain with the spray head connected thereto through said second chain and the connected pair of pulleys of the other of said first and second sets of pulleys.

11. A device as in claim 10 wherein one of the pulleys of each of said first and second sets is larger in diameter than the other pulleys of the set.

12. A device as in claim 11 wherein the larger pulley of each set is one of the pulleys of the connected pair.

* * * * *